United States Patent [19]

Hector et al.

[11] Patent Number: 4,996,113

[45] Date of Patent: Feb. 26, 1991

[54] BRIGHTNESS ENHANCEMENT WITH TEXTURED ROLL

[75] Inventors: Louis G. Hector, Monroeville; Shen S. Sheu, Murrysville, both of Pa.

[73] Assignee: Aluminum Company of America, Pittsburgh, Pa.

[21] Appl. No.: 342,300

[22] Filed: Apr. 24, 1989

[51] Int. Cl.[5] ..... B21D 53/00; B21B 27/02; B23K 26/00

[52] U.S. Cl. ..... 428/600; 428/687; 219/121.67; 72/199; 29/121.4; 29/121.6

[58] Field of Search ..... 428/687, 600, 592, 596; 219/121.67, 121.68, 121.69; 72/199; 29/121.1, 121.4, 121.6, 121.5

[56] References Cited

U.S. PATENT DOCUMENTS

| | | | |
|---|---|---|---|
| 3,956,915 | 5/1976 | Saunders | 72/199 |
| 4,322,600 | 3/1982 | Crahay | 219/121.68 |
| 4,628,179 | 12/1986 | Crahay | 219/121.68 |
| 4,775,599 | 10/1988 | Matsuoka et al. | 428/687 |
| 4,783,378 | 11/1988 | Wakui et al. | 428/687 |
| 4,795,681 | 1/1989 | Furukawa et al. | 72/199 |
| 4,806,724 | 2/1989 | Kawai et al. | 219/121.68 |
| 4,806,731 | 2/1989 | Bragard et al. | 219/121.68 |
| 4,847,112 | 7/1989 | Halleux | 219/121.68 |
| 4,917,462 | 4/1990 | Crahay | 428/687 |

FOREIGN PATENT DOCUMENTS

| | | | |
|---|---|---|---|
| 880796 | 5/1980 | Belgium . | |
| 572306 | 9/1977 | U.S.S.R. | 29/121.1 |

OTHER PUBLICATIONS

Koechner, Walter., "Solid State Laser Engineering", Springer-Verlag, 1988, pp. 431-437.

Gregson, Victor G. et al., "A Physical Model of Laser Heat Treatment", Proceedings of the 1974 Electro-Optical Systems Design Conference Industrial and Scientific Conference Management, Chicago, 1984, pp.237-244.

Adler, Robert, "Interaction between Light and Sound", IEEE Spectrum, 1967, pp. 42-54.

Hecht, Jeff, The Laser Guidebook, McGraw-Hill Book Co., pp. 44-46.

J. Crahay et al., "Gravure de la rugosité de cylindres de laminoir par impulsions Laser", Revue de Metallurgie--CIT, May 1983, pp. 373-401.

*Primary Examiner*—John J. Zimmerman

*Attorney, Agent, or Firm*—Elroy Strickland

[57] ABSTRACT

A method for rolling material between rotating rolls utilizing a lubricant, at least one of the rolls having an anistropic working surface that comprises a topography of smooth bearing areas spaced apart by at least one micron-size groove extending around and along the face of the roll in the general direction of rolling. The groove receives and conducts lubricant freely therealong during the rolling process, i.e., as the material to be rolled is directed through the rotating rolls, and is compressed between the rolls, the smooth-bearing areas force lubricant from the areas to the location of the groove in the roll. In this manner, the material is rolled under boundary lubrication conditions.

28 Claims, 5 Drawing Sheets

BRIGHTNESS ENHANCEMENT WITH TEXTURED ROLL

BACKGROUND OF THE INVENTION

The present invention relates generally to rolling metal products and particularly to providing such products with an anisotropic engineered surface texture that provides improved uniform brightness.

A surface appears bright to the human eye when the surface reflects incident light specularly, i.e., when the light striking the surface is not significantly diffused. Specular reflection, in turn, requires a non-random surface finish so that light is reflected from the surface at the same angle it was incident to the surface (which is the definition of specular reflection). A random surface diffuses incident light and thus makes the surface appear dull to the human eye, i.e., incident light is reflected randomly in many directions because of the random orientations of surface roughness; the internal order of the incident light is hence not preserved.

In providing a rolled sheet product with a bright surface, the surface of the work roll employed to produce the product must also have a topography that is engineered to provide a high degree of regularity. Traditional methods of finishing work rolls involve one or more grinding operations. Grinding, however, does not provide roll surfaces with uniform textures since grinding is very much a stochastic process which results in a ground texture height, measured from an average datum line from which average roughness can be measured, that follows a normal or Gaussian distribution. The distribution of roughness is influenced by the abrasive particle size in the grinding medium (wheel), the feed rate of the roll in relation to the grinding medium, depth of cut and the number of grinding passes.

In manufacturing aluminum can end stock, for example, the customer desires the stock (sheet) to have a uniformly bright, highly reflective surface, with a certain composite surface roughness that is smooth to the human touch and appears shiny to the human eye. This requires the rolling operation to be conducted in the boundary lubrication regime, which means that there is significant metal-to-metal contact. The texture of the roll surface may then be faithfully imprinted onto the sheet surface.

With present state-of-the-art roll grinding, the rolling of aluminum sheet in the boundary lubrication regime to create a bright surface at high speeds (e.g. 4000 ft. per minute) is difficult with relatively large (typically 22 inch diameter) work rolls. There are three primary reasons for this: (1) the grinding process generates variable depth grooves, i.e., the depths of two successive grooves may be quite different in the roll surface, which results (locally) in partial or total separation of the roll surface from the sheet surface due to the generation of thick lubricant films, (2) a ground roll surface produces a non-uniform texture height on the sheet surface due to the Gaussian distribution of surface roughness, as discussed above, resulting in diffuse reflection of light, and (3) a ground roll surface has non-uniform wear characteristics, which result in inconsistencies in the rolling operation, i.e., rolling speed must be changed (lowered) to accommodate the worst case condition on the roll surface. (Ground rolls, in addition, require frequent regrinding, which adds cost to the rolling process.) It is well known that the thickness of a lubricating film is a function of the square root of roll diameter such that larger work rolls are more of a problem than smaller work rolls. In reference to rolling speed, film thickness is a linear function of velocity.

As explained earlier, a bright, highly specularly reflective surface is one that reflects light primarily at the angle at which the light strikes the surface, i.e. the angle of incidence, rather than reflecting the light in a diffuse manner. The ratio of diffuse to specular reflection, which is the amount of reflected light measured at the angle of incidence compared to the amount of light measured at two degrees from incidence, is a good measure of surface brightness. The lower this ratio the greater is the surface brightness.

Diffuse reflection may also occur in the presence of micro-size cracks or fissures. Fissures are generally created when a product is rolled under hydrodynamic lubricating conditions which means that roll and product surfaces are either locally or entirely separated by a lubricant film. This is especially true for the high speeds at which aluminum sheet is rolled. If fissures pre-exist in the product surface, they may be enhanced since the hydrodynamic pressure in the lubricant film forces lubricant into such cracks to widen and deepen them. Fissures generally extend in a direction that is transverse to the direction of rolling, and can occur in both steel and aluminum products.

The result, then, of a ground roll surface is a random, stochastic texture imparted to a rolled product's surface, including fissures, such that the surface appears dull to the human eye.

SUMMARY OF THE INVENTION

The present invention is directed to the consistent, repeatable production of bright metal surfaces. This is accomplished by rolling the product under primarily boundary lubrication conditions, after the face or surface of at least one work roll has been provided with precision, consistently formed, discrete, minute, micron-size grooves and preferably after the roll surface has been polished to a mirror finish.

Hence, between the minute grooves are the mirror finished areas, which are planar, and which provide smooth bearing surfaces that bear against the product, as it is rolled, to force lubricant from the bearing surfaces to the grooves so that the lubricant flows in the grooves at the entry of the roll bite The results are (1) no thick layer of lubrication is available to open up the surface of the product bearing against the roll to create and/or enhance microcracks in the product surface, and (2) the bearing areas smear the surface of the product which enhances product brightness. The surface of the rolled product appears uniformly bright to the human eye, with a diffuse to specular reflection ratio on the order of 0.005 in the rolling direction. Such a grooved surface is anisotropic, which means the surface does not exhibit properties having the same measured values along all measuring axes in all directions.

It is thus a primary objective of the present invention to provide a rolled metal product with improved brightness over metal rolled with conventionally ground rolls. A further objective is to provide the working surface of a mill roll with a texture that produces such an improvement in brightness.

It is yet another object of the invention to provide a roll surface that rolls a metal product under boundary lubrication conditions, such conditions being effected by at least one peripheral, clean cut groove provided in the roll surface and extending in the general direction of rolling, the groove encircling the roll a multiple of times along the length of the roll. The groove is of micron size in width and depth; the multiple encircling grooves are spaced from each other by a distance on the order of five to 300 microns.

It is a further objective of the invention to provide a roll surface having extended life and wear characteristics such that frequent regrinding of the rolls is not necessary and therefore the cost of grinding and the manufacturing process as a whole is reduced.

Another objective of the invention is to provide a roll surface that generates a minimum of debris so that neither the roll surface nor the product surface is significantly marred by debris and the filtration load on the mill oil house is greatly reduced (rolling lubricants used in large mills are generally recycled through filtering apparatus located in "oil houses," physically separated from the mills but connected in fluid communication with the mills to receive "dirty" lubricant from the mill and return clean lubricant to the mill.).

Another objective of the invention is to provide a groove shape in a work roll surface that receives material undergoing substantial reduction in thickness yet does not retain or seize the material.

A further objective of the invention is to provide a textured roll surface by employment of precision contact and non-contact machining techniques.

Yet another objective of the invention is to provide a rolled product with a surface texture having uniformly consistent ridges or plateaus spaced apart by planar areas or valleys which are mirror finished.

Unlike the prior art which discloses the use of continuous-type lasers to score roll surfaces, the present invention employs pulsed-type lasers, such as carbon dioxide ($CO_2$), Neodymium:Yittrium-Aluminum-Garnet (Nd:YAG) or Excimer lasers, which afford maximized peak powers yet minimize the average heat input into a roll surface while providing superior control over the shape of the texture scored in the roll surface. Further, pulsed lasers require no external mechanical manipulation of the laser beam prior to its impingement against the surface to be machined.

The preferred embodiment involving a laser device is the Nd:YAG laser since its output is more focusable thereby enhancing the precision of the scoring work and it is generally easier to maintain compared to a $CO_2$ laser. The grooved profile can also be produced by a cubic boron nitride or diamond tool that has been precisely shaped to a desired profile by a diamond grinding tool, for example, or by wire or ion-beam machining.

The use of a continuous wave $CO_2$ laser to inscribe a texture on a mill roll is shown in U.S. Pat. No. 4,322,600 to Crahay. Crahay employs the laser to form, i.e., burn perforations and microcavities in the roll surface, such a surface being used to roll steel sheet. A flow of oxygen gas is employed to enhance the burning process.

Another patent directed to the use of lasers for machining a roll surface is U.S. Pat. No. 4,628,179, again to Crahay. Crahay here employs a laser or electron beam to provide an isotropic surface roughness by overlapping and substantially filling grooves formed in the roll surface by the laser or electron beam. Crahay states that the desired isotropy of roughness can only be obtained if two successive paths of the beam have sufficient overlap. This means that the second pass is required over the course of the first pass such that material of the roll is fused and displaced (again using oxygen for a burning process) into the first pass thereby essentially filling and covering the first pass altogether. Hence, the patentee states that the spot size of the beam is 120 microns and successive spots overlap in 100 micron intervals, as they trace a helical course around the roll. Crahay's isotropy is said to be achieved by the ratio of the pitch of a helical course to the width of a beam path being less than one.

It is anticipated that the use of the technique of the second Crahay patent, as discussed above, will lead to significant wear debris generation during high speed rolling of non-ferrous metals such as aluminum. This would lead to a product surface having a higher concentration of wear debris, as well as a coating of the roll surface with the debris, i.e. metal transfer, since the roll roughness and subsequent lubricant flow are not controlled in the manner described herein.

THE DRAWINGS

The invention, along with its objectives and advantages, will be best understood from consideration of the following detailed description and the accompanying drawings in which.

Figure 1:
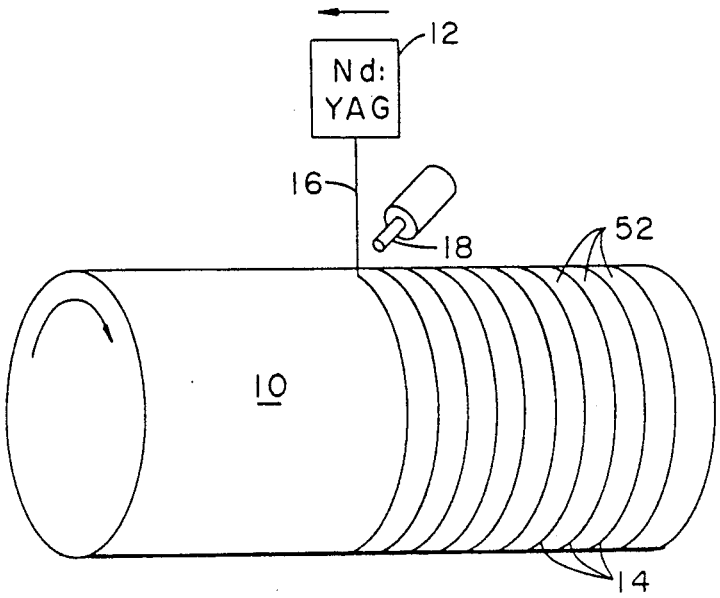
FIG. 1 shows schematically a laser device for precision texturing of the surface of a steel roll in accordance with the principles of the present invention.
Figure 5:
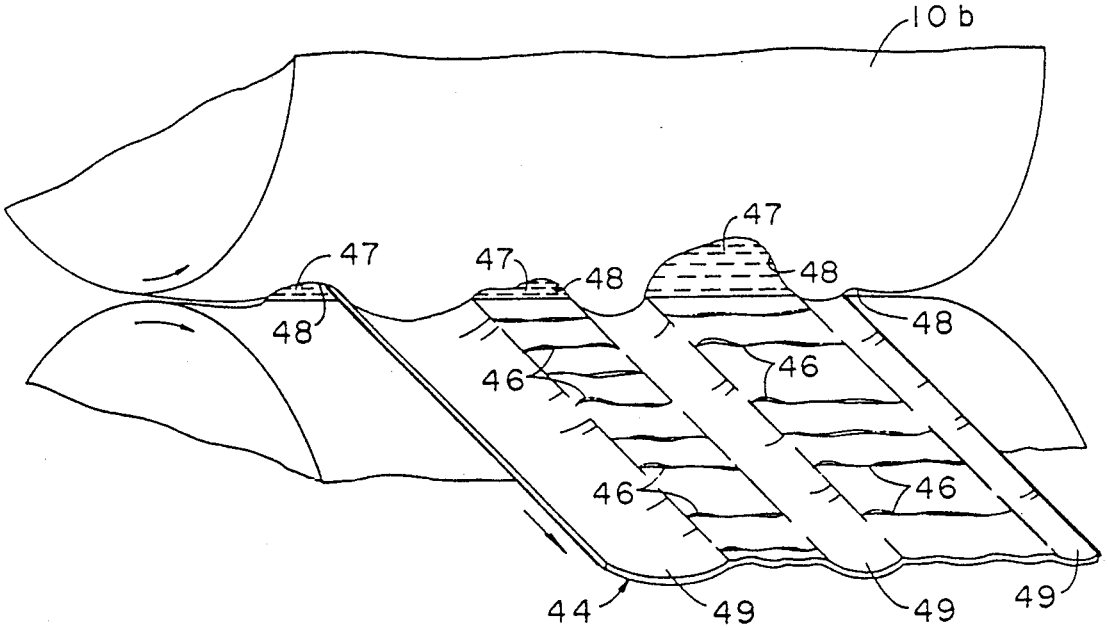
FIG. 5 (PRIOR ART)
Figure 4:
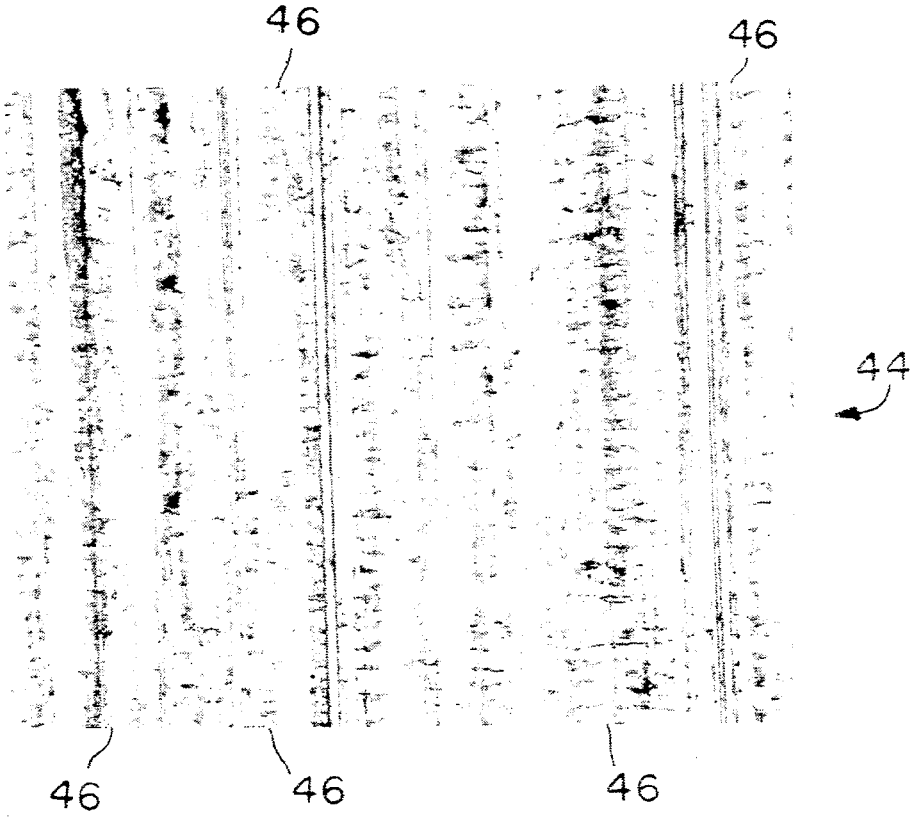
FIG. 4 PRIOR ART
Figure 7:
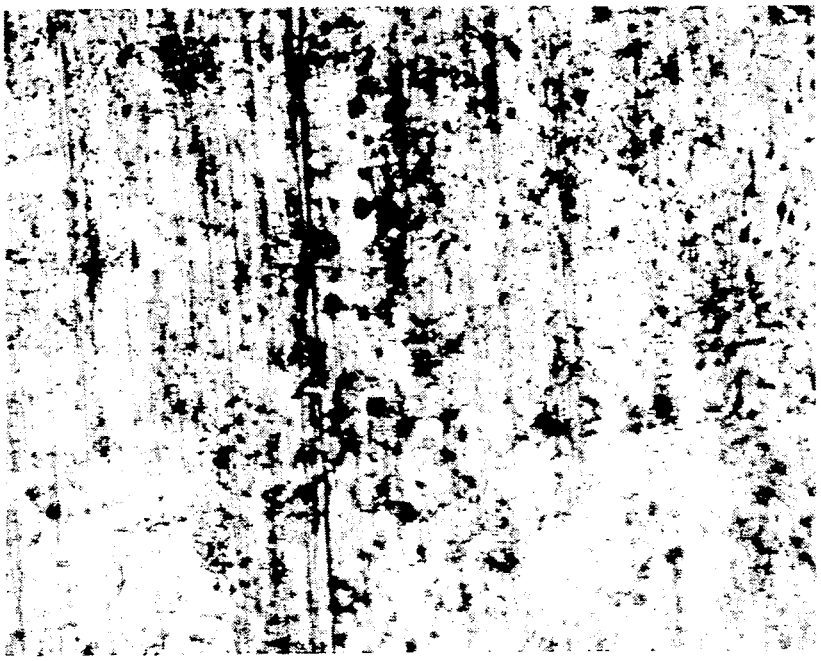
Figure 8:
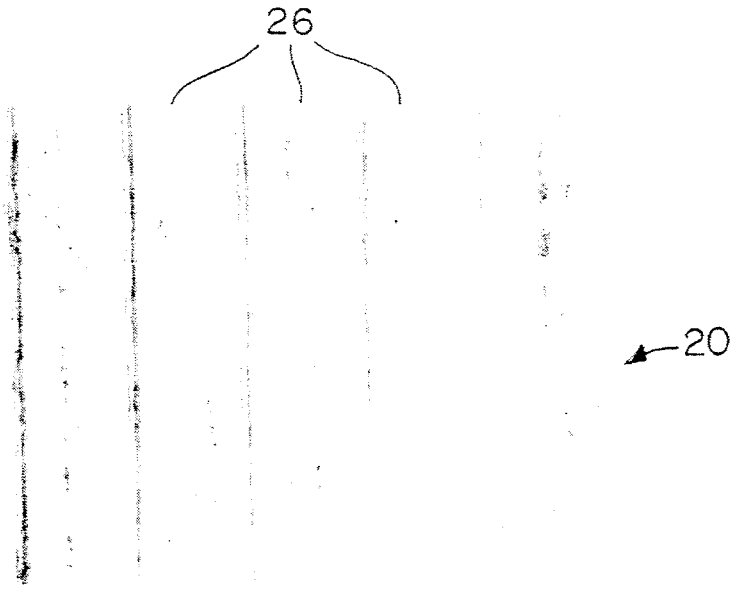
Figure 6:
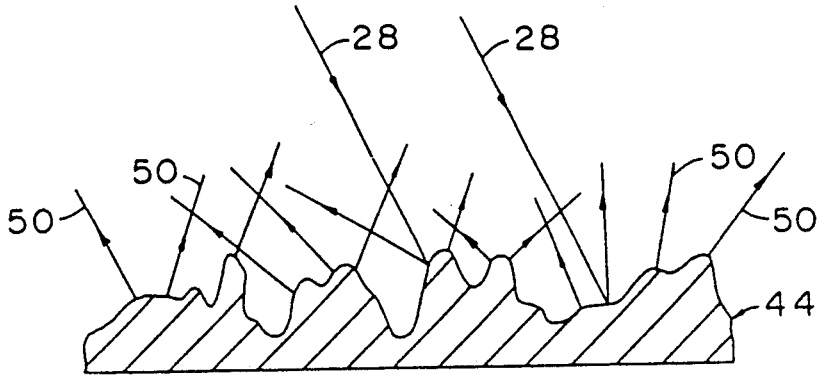
FIG. 6 (PRIOR ART)
Figure 9:
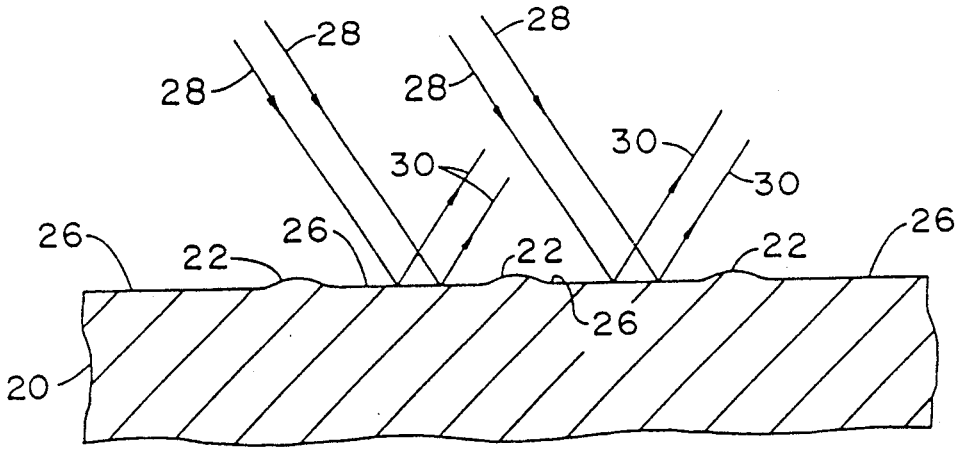
Figure 10:
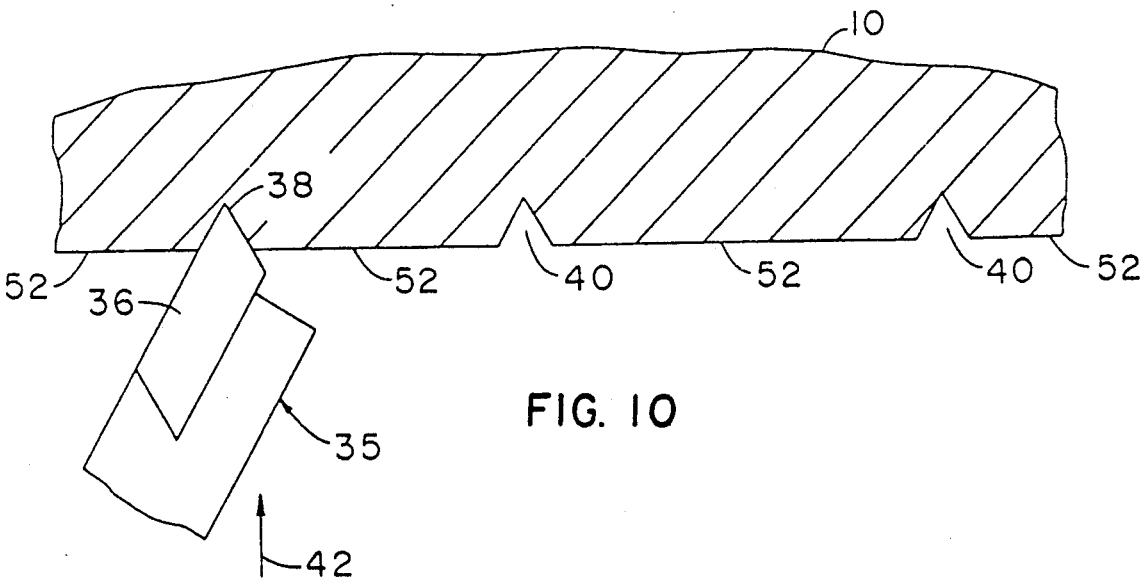

FIG. 4 is a photomicrograph of a surface of a sheet of aluminum alloy 5182 magnified 200 times. The sheet underwent a 17% reduction in thickness with a ground roll surface. The photomicrograph shows a surface texture littered with fissures, which are small microcracks extending in a direction generally transverse to the direction of rolling;

FIG. 5 shows the mechanism by which the fissures of FIG. 4 are generated during rolling;

FIG. 6 shows schematically diffuse reflection of light from a surface having random crests and valleys;

FIG. 7 is a photomicrograph of the surface of a second sheet of 5182 alloy magnified 200 times, the sheet having been rolled by a roll whose working surface was prepared by electric discharge machining;

FIG. 8 is a photomicrograph of another aluminum sheet, magnified 200 times, showing the substantial absence of transverse fissures of microcracks;

FIG. 9 shows diagrammatically the surface of a sheet as rolled by the textured roll of FIG. 1; and FIG. 10 shows a work roll in partial section provided with minute grooves formed by a micron size cutting insert mounted in a tool holder.

PREFERRED EMBODIMENTS

Referring now to FIG. 1 of the drawings, a tool steel work roll 10 of a rolling mill (not otherwise depicted in the drawings) and a Nd:YAG laser 12 are shown schematically in the process of machining micron size helical grooves 14 in the roll surface. The grooves extend continuously in the general direction of rolling. As depicted (in plan view) grooves 14 are disposed in a side-by-side manner, though they may, in fact, comprise a single continuous groove that extends helically about and along the length of the roll. The number of grooves or revolutions of a single groove depends upon the width of the strip to be rolled.

The Nd:YAG laser incorporates a Q switch which provides a high intensity (pulsed) beam of energy 16 having a wavelength primarily of 1.064 microns which is in the invisible portion (near infrared) of the electromagnetic spectrum. Q-switching is described in some detail in "Solid State Engineering", Second Edition by Walter Koechner, Springer-Verlag, 1988. Basically, it involves the collection of the energy of the laser's pump lamp in the lasing element, and then dumping the collected energy into short pulses of 100 nanoseconds or so. With Q-switching, the peak powers of the beam can be increased significantly yet can be maintained in minute bundles or pulses of energy, sufficient enough to score metal surfaces.

The width of beam 16 is five to ten microns (depending on the focusing optics within the device) such that, with the above intensity (pulsed power) of the beam, each pulse of the beam vaporizes a spot on the surface metal of a tool steel roll art a width or diameter corresponding to the beam width when the beam strikes the roll surface without substantial melting of the steel. A discrete, minute groove 14 is thereby formed in the surface of roll 10 when the beam and roll are relatively moved. Preferably, the roll is rotated about its axis and is moved longitudinally, lengthwise of the roll. The frequency and wavelength of a Nd:YAG or Excimer laser is such that their beams can micromachine a groove in a working surface on the order of the width or cross section of the beams, the wavelength of the YAG or Eximer laser being more efficient in penetrating (coupling to) the metal of a workpiece than that of a $CO_2$ laser. If the frequency of the laser is doubled (which yields a beam at the one-third the 1.064 micron wavelength), or quadrupled (which yields a beam at one-fourth the 1.064 micron wavelength) a groove is formed that is respectively half, one-third or one-fourth the size of the groove formed without frequency doubling, tripling or quadrupling. For example, the Nd:YAG laser can form a groove having a width of eight microns in a steel workpiece. Doubling the laser frequency will form a four micron wide groove due to the smaller emitted wavelength. The beam produced by frequency doubling couples more efficiently to steel surfaces than the original 1.064 micron wavelength of the laser such that the machining effected by the pulsed beam is finer in cross section. Frequency doubling can be effected by having the laser end-pump a Lithium Iodate ($LiIO_3$) crystal. The desired output of the $LiIO_3$ crystal lies in the green portion (0.532 micron) of the electromagnetic spectrum. A groove width of four to twenty microns is suitable for rolling aluminum sheet, with a groove depth in the range of 0.5 to five microns. Depth is controlled by the power of the pulsed beam and the time a given section of steel surface is exposed to the beam.

Generally, the lower the wavelength of the laser beam, the finer the cut effected by the beam.

Figure 2:
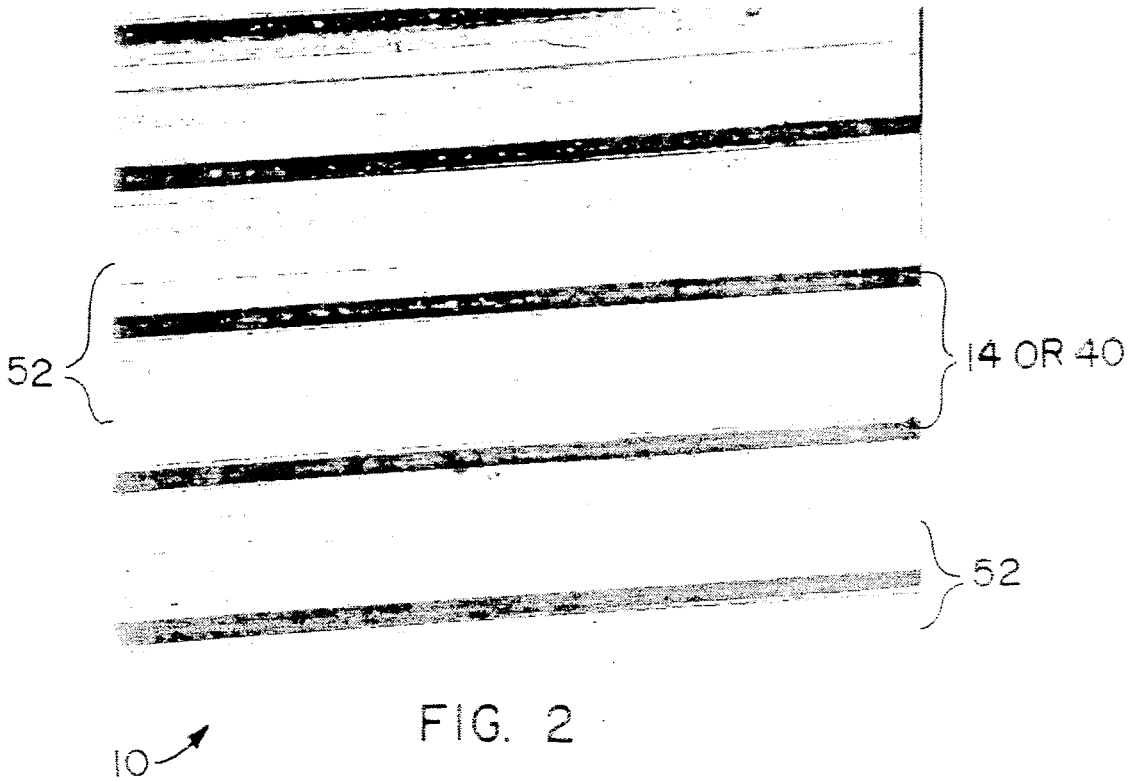
FIG. 2 is a photomicrograph of an AISI 52100 steel roll surface magnified 200 times, the surface being provided with micron size grooves by the laser of FIG. 1. (Material displacement on the roll surface caused by deposition of vaporized surface material has been removed and the surface coated with a layer of chrome).

In forming groove 14, the vaporized metal is moved ahead of beam 16 by directing a flow of air from a nozzle 18 located behind the beam. (As depicted in FIG. 1, nozzle 18 is shown in perspective and off-center of beam 16 for purposes of illustration only.) The source of the air can be "plant" air, which is ordinarily available in factories and shops. The flow of air from 18 is effective to move vaporized metal ahead of the laser beam to preheat the roll surface just ahead of the beam. The flow from 18 is also effective to limit the amount of vaporized metal depositing on the banks of the groove (FIG. 3) and on the optics (not visible in FIG. 1) that focus beam 16 on the roll surface. In the case where metal deposits reach the banks of the groove, the roll is lightly polished to remove such deposits after the machining process has been completed. This is the case of the photomicrograph of the roll surface shown in FIG. 2 of the drawings. In FIG. 2, the grooves are the dark lines that extend nearly perpendicular to the roll axis. The grooves are 15.0 microns wide and are spaced from each other by a distance of 113.0 microns.

The beam of a Nd:YAG laser characteristically produces generally wedge or truncated triangular shaped grooves (in cross section transverse of the width of the grooves) in the surface of a roll. When rolling a strip 20, such as shown in partial section in FIG. 9, with such wedge-shaped grooves, a small fraction of the strip surface material flows into the grooves partially filling them. This is a plastic deformation process known as micro-backwards extrusion. The effect of the grooves is thus to produce narrow wedge-shaped raised portions or ridges 22 (FIG. 9) on the strip surface. Between the ridges are substantially smooth areas 26 that reflect incident light 28 in a specular manner 30 such that strip 20 is bright to the human eye. The ridges 22, being only a few microns wide, are not clearly visible to the human eye.

An instrument capable of producing continuous grooves in a working surface that are other than wedge shaped is a cutting tool 35, as shown schematically in FIG. 10 in elevation. The tool includes an insert 36 having a hard, very minute, micron size cutting edge 38 of a predetermined shape in cross section. The cutting edge is capable of cutting a groove 40 in roll 10 of a size and cross sectional shape corresponding to the size and shape of 36 when it engages the roll surface under appropriate force, as indicated by arrow 42 in FIG. 10 and the insert and roll relatively moved. The cross section of the insert can be substantially triangular (as shown), semi-circular or Gaussian (bell shaped) and hence is not limited to the wedge shape provided by the beam of laser 12. The insert 36 can be sized to provide grooves in roll 10 of a depth in the range of 0.25 to five microns and a width in the range of 2.5 to 25 microns. In the cases of triangular, semi-circular or Gaussian-shaped grooves, the width is measured at the base of the grooves, which is in the plane of the surface of the roll. The width of the areas (52) between the grooves lies in the range of five to 300 microns. When such a groove in the roll engages material 20 (FIG. 9) in the rolling, thickness reduction process, the material of 20 extrudes into the groove to form a ridge configuration approximating the transverse cross section of the insert.

The material of insert 36 is preferably cubic boron nitride. Such material is commercially available and used as a metal cutting (severing) tool. The cutting surface of such a nitride material is appropriately shaped to a micron size configuration by a diamond grinding tool or by ion-beam machining.

In FIG. 10, the roll and tool are relatively moved to form grooves 40. If the grooves (in elevation) are formed as a single continuous helical groove, the roll can be rotated about its rolling axis and the tool translated laterally.

Any of the groove shapes provided by insert 36 and laser beam 16 are such that when a strip of metal is reduced in thickness in passing between the work rolls of a rolling mill, which reduction occurs under massive, compressive forces, as discussed above, the metal of the strip extrudes into the grooves but is not retained in the grooves such that the roll remains clean and uncoated with the metal of the strip. This may be ensured through the use of a roll coating, such as chrome. In any case, the surface of the strip is not marred by debris clinging to the surface of the roll.

Figure 3:
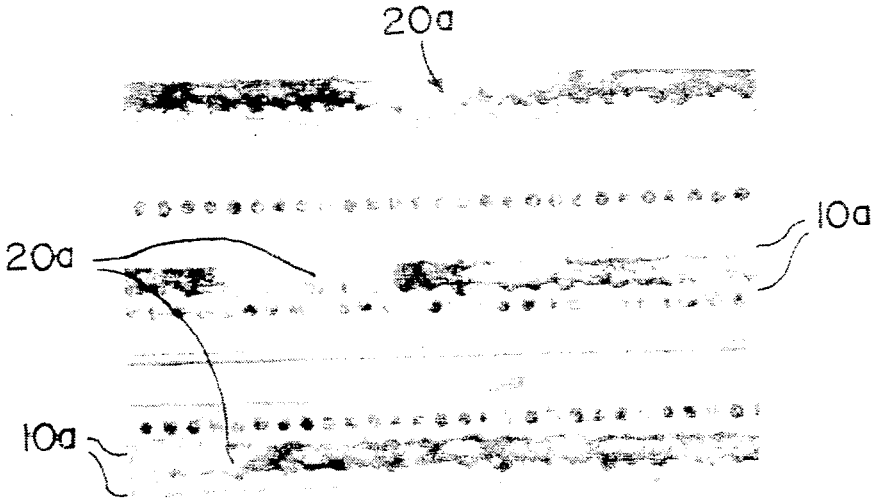
FIG. 3 is a photomicrograph of a AISI 52100 steel roll surface (magnified 200 times) that has been textured in the manner of FIG. 2 but which contains material deposition along the banks of the grooves.

After grooves 14 are formed in the surface of a roll by laser 12, the roll is polished to remove any deposition of roll material that may not have been cared for by the stream of air from nozzle 18. FIG. 3 of the micrographs shows a situation where material deposition 10*a* of the roll has not only not been removed but which forms jagged edges on and along the banks of the grooves in the roll. The jagged edges pick up or seize material of strip 20 and embed the same (20*a*) in the surface grooves. (The embedded material 20*a* shown in FIG. 3 is a 5182 aluminum alloy, the strip of the material having undergone a twenty percent reduction in thickness.) Once embedded, the strip material is virtually impossible to remove from the grooves. It is therefore imperative that any material deposition on the groove banks be removed from the roll before it is used. Such deposits can be removed by a light polishing operation that does not otherwise affect the roll topography. A suitable polishing procedure involves manually buffing the roll surface with a cloth and a fine diamond paste, though other procedures can be used to remove deposits. The life of the polished roll can be further extended by plating the roll with a coating of material such as chrome.

FIG. 4 of the micrographs shows a sheet surface texture 44 that is seemingly oriented in one direction yet is actually quite random and literally littered with small micro cracks or fissures 46. These fissures generally extend transverse to the direction of rolling. They are the result of thick films of lubricant 47 locally entrapped and confined in random, narrow and discontinuous depressions 48 in a ground roll surface 10*b*, as depicted in exaggerated form in FIG. 5., i.e., FIG. 5 shows a ground roll surface greatly enlarged to depict random roughness. Between the depressions are narrow discontinuous peaks that engage and form elongated, discontinuous depressions 49 in the surface of sheet 44, as the sheet is reduced in thickness. The lubricant trapped in depressions 48 thereby becomes highly pressurized, as it cannot escape the depressions, and is forced against the sheet surface. The pressure is sufficient to open (crack) the surface of the sheet. This is the problem in FIGS. 4 and 5, the sheet in the micrograph of FIG. 4 having undergone a reduction in thickness of 17%. Such a surface and texture is also shown diagrammatically and in cross section in FIG. 6 of the drawings. In FIG. 6, the sectional view is employed to show texture randomness in both a roll and sheet surface.

FIG. 7 of the drawings shows the texture of a sheet of 5182 aluminum (magnified 200 times) that has been rolled with a work roll having its surface machined by electric discharge machining (EDM). Such a technique produces overlapping pits or craters in the roll surface. When an aluminum sheet is rolled with such a pitted surface, the sheet surface acquires debris (the dark areas in FIG. 7) in the form of aluminum oxide which significantly degrades sheet surface quality. The surface debris is generated by the random roughness of the roll which produces a "sand paper" effect, i.e., a fine particle debris occurs that is similar to that produced when one sands a wood surface with sand paper.

Hence, the surfaces of the rolled product of FIGS. 4, 5, 6 and 7 are dull, as incident light 28 striking the surfaces is diffused from the surfaces. The diffused light is indicated by numeral 50 in FIG. 6. The diffused light in FIG. 6 is in contrast to the highly directional specularly reflected light 30 in FIG. 9. The diagrammatic presentation of FIG. 9 represents the surface of sheet 20, as depicted by the micrograph of FIG. 8, said surface being substantially free of debris and fissures.

Referring again to FIGS. 1, 2, and 10, continuous grooves 14 or 40 in roll 10 are separated by substantially smooth, relatively broad areas 52 that extend about the roll surface, with the grooves, the width of the broad areas being on the order of five to 300 microns. The width of these areas, in any given case, is chosen in accordance with such rolling parameters as the material (alloy) being reduced in thickness, the composition of the lubricant employed and speed of the rolling process. Areas 52 provide broad smooth bearing surfaces that bear against strip 20 (FIG. 8) during the rolling process to form the broad, smooth and bright planar surfaces 26 on the surface of the strip. Areas 52 reduce the thickness of strip 20 under boundary lubrication conditions, i.e., any lubricant existing or entering between roll surfaces 52 and strip surfaces 26 is forced from the broad areas of 52 into grooves 14 or 40 provided in the roll such that virtually no thick film of lubricant is maintained between surfaces 52 and 26 during the rolling process. When the lubricant reaches the grooves it is freely channelled therealong as the rolls rotate against the strip. The lubricant is thus not confined in the manner described above in connection with the discontinuous depressions of ground rolls. Since the lubricant is not confined, the pressure of the lubricant does not grow and increase to cause cracking of the strip surface. In the broad areas of 52 and 26, no lubricant is available to open up the strip surface so that the strip exiting the mill is substantially free of transverse fissures. Neither do surfaces 26 contain random size valleys and crests, as the surface of roll 10 does not contain random valleys and crests. The surface of strip 20 is now comprised of a combination of broad, substantially smooth areas 26 of precisely chosen widths separated by ridges 22 of precise height, width, and configuration.

Further, in the process of reducing the thickness of strip 20, the bearing areas 52 of roll 10 "smear" the surface of the strip engaging such bearing areas. Smearing is a process in which the force of the rolls bearing against the strip being rolled smooths out any remaining uneven profiles on the strip surface so that its specularly reflective capability is further enhanced.

A further enhancement of reflectivity is effected by highly polishing the surface of roll 10 before it is machined by laser 12 or tool 35. This provides highly polished bearing areas 52 which transfer their polished characteristic to the rolled product in the thickness reduction process, and enhance the smearing or smoothing process.

Roll 10 of the invention is thus provided with an engineered, predictable, non-random surface finish and texture made possible by pulsed laser beam 16 or cutting insert 36. Such an engineered roll surface provides an anisotropic, predictable, engineered strip having the desired uniformly bright surface. The texture of the roll is anisotropic, as it is provided with discrete grooves 14 or 40 spaced apart by bearing areas 52, with a pitch to groove ratio of 2.0 or greater.

While the invention has been described in terms of preferred embodiments, the claims appended hereto are intended to encompass all embodiments which fall within the spirit of the invention.

What is claimed is:

1. In a method of rolling material between rotating rolls utilizing a lubricant and having an anisotropic working surface on at least one roll which comprises a topography of smooth bearing areas that roll the material under boundary lubrication conditions, said bearing areas being spaced apart by at least one micron size groove extending around and along the surface of the roll in the general direction of rolling to receive and conduct lubricant therealong, the method comprising:

polishing the working surface of said roll to a mirror finish before the groove is provided in the working surface of said roll, providing said groove in said working surface, removing material deposits from the working surface and banks of the groove by a second polishing operation without disturbing the topography of the groove, coating the working surface and groove with a hard, dense material, directing the material through the rotating rolls, compressing the material between said rolls, and imparting a reverse topography corresponding to the one roll to one surface of a product rolled from said material by said rolls.

2. The method of claim 1 including forming the groove in the working surface of the roll by use of a focussed beam of energy emitted by a Nd:YAG or Excimer laser directed to the working surface as said surface and beam are relatively moved.

3. The method of claim 2 including using the beam of energy to vaporize the material of the working surface as it strikes the surface, directing a gaseous stream adjacent the region of contact between the beam and surface to move the vapor ahead of the beam as the roll and beam are relatively moved, thereby preheating the working surface in an area thereof ahead of the beam, and using the moving vapor to minimize deposition of roll material on the banks of the groove and on optics employed to focus the laser beam.

4. The method of claim 2 including doubling the frequency of the laser to provide a groove in the working surface of the roll of at least four and not more than twenty microns in width.

5. The method of claim 1 in which the micron size groove is provided by a tool having a predetermined profile and micron size cutting edge in cross section.

6. The method of claim 1 including providing the bearing areas with a width in the range of five to 300 microns.

7. The method of claim 1 including providing the groove with a width of at least 2.5 and not more than twenty-five microns and a depth in the range of 0.25 to five microns.

8. A method of rolling a metal strip in a rolling mill at high relative speeds and under boundary lubrication conditions, the working surface of at least one of the rolls of the mill having a mirror finish in which are provided minute continuous grooves that extend around the roll in the general direction of rolling, and polished in a manner that does not change the dimensional integrity of the groove structure, the grooves being spaced from each other a distance of five to 300 microns, said grooves having a depth of 0.25 to five microns and a width of 2.5 to 25 microns, the method comprising:

directing the strip through the rolls of the mill such that the spaces between adjacent grooves of the one roll provide bearing surfaces that engage the strip under boundary lubrication conditions, which squeezes lubricant to the minute grooves, and using said minute grooves to channel the lubricant in the grooves, as substantial reduction in strip thickness is taken.

9. A method of providing the working surface of a roll with an anisotropic texture of predetermined consistently controlled dimensions, comprising:

polishing the working surface to a mirror finish, providing a beam of energy from a Nd:YAG or excimer laser source, focusing said beam to provide a minute beam size in cross section, relatively moving the roll and laser source, directing the focussed beam to the working surface of the roll, using the focussed beam to helically inscribe at least one continuous groove of micron size in the mirror finish of the roll surface and at a pitch to groove width ratio of 2.0 or greater, and coating the working surface of said roll with a hard, dense material.

10. The method of claim 9 including using the focussed beam to inscribe a wedge shaped groove in the roll surface.

11. A roller product having a highly specularly reflective surface provided by an anisotropic texture comprised of reflective surface areas extending substantially lengthwise of the product and spaced apart across its width by ridges, the reflective surface areas and ridges having predetermined controlled consistent dimensions in micron size ranges, with the reflective areas being substantially free of cracks and fissures, as provided by a rolling process that irons the product surface with a roll having a mirror finish and a micron size groove that forms the ridges in the product surface.

12. The product of claim 11 in which the configuration of the micron size ridges in transverse cross section is wedge shaped.

13. The product of claim 11 in which the configuration of the micron size ridges in transverse cross section is substantially triangular.

14. The product of claim 11 in which the configuration of the micron size ridges in transverse cross section is substantially semi-circular.

15. The product of claim 11 in which the configuration of the micron size ridges in transverse cross section is substantially Gaussian.

16. The product of claim 11 in which the material of the product is aluminum or an aluminum alloy.

17. A rolled product having at least one anisotropic textured surface of micron size ridges separating highly reflective areas extending substantially lengthwise of the product, said product being formed by the method of:

passing metal material through lubricated rotating rolls of a rolling mill, at least one of the rolls having a textured surface comprised of at least one micron size groove extending around the roll in the general direction of roll rotation, which groove separates mirror finished bearing surfaces of the roll, compressing said metal material between the rotating rolls, using said compression to form at least one ridge in the material corresponding to said groove, as the material passes through the rolls in the process of producing the rolled product, using said groove to receive and conduct lubricant therein an therealong, as the bearing surfaces of the roll engage the metal material under boundary lubrication conditions in producing the rolled product.

18. The rolled product of claim 17 in which the metal is aluminum or an alloy of aluminum.

19. The rolled product of claim 17 in which the reflective areas have a width in the range of five to 300 microns.

20. The rolled product of claim 17 in which the ridges have a height of 2.5 to five microns and a width at their base of 02.5 to 25 microns.

21. The method of providing the working surface of a roll with an anisotropic texture of predetermined, consistently controlled dimensions with a cutting tool capable of inscribing a micron size groove in the surface of the roll, said tool having a predetermined micron size cutting edge and configuration, the method comprising:

polishing said working surface to a mirror finish, relatively moving the roll and tool, engaging the roll surface with the cutting edge of said tool, using the cutting edge to helically inscribe at least one continuous groove of micron size in the roll surface in the general direction of rolling, and thereafter coating said working surface with a hard, dense material.

22. The method of claim 21 including providing the cutting edge with a profile in transverse cross section selected from the group consisting of triangular, semi-circular or Gaussian profiles, and using such a configuration to inscribe a triangular, circular or Gaussian shaped groove in the roll surface.

23. The method of claim 21 including using a cubic boron nitride tool to inscribe the groove in the roll surface.

24. The method of claim 21 including inscribing a groove in the roll surface that has a depth in the range of 0.25 micron to five microns, and a width in the range of 2.5 microns to 25.0 microns.

25. The method of claim 21 including separating the grooves in the roll surface by a distance in the range of five to 300 microns.

26. A method of rolling metal material between the work rolls of a rolling mill, comprising:

directing the material between said rolls, at least one of which has a mirror finish and a topography of smooth-bearing areas spaced by at least one continuous micron size groove extending around the roll by several revolutions in the general direction of rolling, said finish and topography having a coat of hard, dense material, introducing a lubricant against the working surfaces of said rolls, rotating the rolls, maintaining a compressive force against the material between the rotating rolls sufficient to reduce substantially the thickness of the material under boundary lubrication conditions, and imparting a reverse topography corresponding to the topography of the one roll to one surface of the material reduced in thickness to produce a metal product having substantially said reverse topography and mirror finish of said one roll.

27. A textured roll for rolling material in a rolling mill under boundary lubrication conditions, said roll having an anisotropic working surface which includes smooth mirror finished bearing areas spaced by discrete, micron size grooves extending helically around and along the roll in the general direction of rolling to receive and conduct lubricant therein during a rolling operation, said bearing areas and micron size grooves being coated with a hard, dense material, with said bearing areas having a width in the range of five to 300 microns, said grooves having a depth of 0.25 to five microns, and a width of 2.5 to 25 microns.

28. A sheet product having a highly specularly reflective surface provided by an anisotropic texture comprised of reflective surface areas extending substantially lengthwise of the sheet product and spaced apart across its width by ridges, the reflective surface areas and ridges having predetermined, controlled, consistent dimensions in micron size ranges, with the reflective areas being substantially free of micron size cracks extending between the ridges, as provided by a rolling process that irons the product surface with a roll having a mirror finish and micron size groove in said mirror finish that forms the ridges in the product surface.

* * * * *

UNITED STATES PATENT AND TRADEMARK OFFICE

CERTIFICATE OF CORRECTION

PATENT NO. : 4,996,113

DATED : February 26, 1991

INVENTOR(S) : Louis G. Hector and Shen S. Sheu

It is certified that error appears in the above-identified patent and that said Letters Patent is hereby corrected as shown below:

| | |
|---|---|
| Col. 2, line 47 | After "roll bite" insert --.-- |
| Col. 4, line 54 | Change "of" (second occurence) to --or-- |
| Col. 5, line 24 | Change "art" to --at-- |
| Col. 5, line 38 | Delete "one-third the" |
| Col. 5, line 39 | After "wavelength)," insert --or tripled (which yields a beam at one-third the 1.064 micron wavelength)-- |
| Col. 11, line 11 | Change "an" to --and-- |

Signed and Sealed this

Twenty-fourth Day of November, 1992

*Attest:*

DOUGLAS B. COMER

*Attesting Officer*

*Acting Commissioner of Patents and Trademarks*